US007510419B1

(12) United States Patent
Sullivan et al.

(10) Patent No.: US 7,510,419 B1
(45) Date of Patent: Mar. 31, 2009

(54) EASILY-REMOVEABLE ELECTRICAL CONNECTOR

(75) Inventors: Gerald G. Sullivan, Chelmsford, MA (US); Andrew R. Marquis, Medford, MD (US)

(73) Assignees: Verizon Services Organization, Inc., Irving, TX (US); Verizon Services Corp., Arlington, VA (US)

( * ) Notice: Subject to any disclaimer, the term of this patent is extended or adjusted under 35 U.S.C. 154(b) by 0 days.

(21) Appl. No.: 11/957,923

(22) Filed: Dec. 17, 2007

(51) Int. Cl.
*H01R 4/50* (2006.01)

(52) U.S. Cl. ..... 439/344; 439/354

(58) Field of Classification Search ..... 439/344, 439/354, 357, 358
See application file for complete search history.

(56) References Cited

U.S. PATENT DOCUMENTS 5,993,236 A * 11/1999 Vanderhoof et al. ..... 439/344
5,993,237 A * 11/1999 Kern et al. ..... 439/344
6,364,685 B1 * 4/2002 Manning ..... 439/357
6,835,086 B1 * 12/2004 Tsai ..... 439/354
6,866,532 B1 * 3/2005 Huang ..... 439/344
7,101,212 B1 * 9/2006 Larkin ..... 439/344

* cited by examiner

*Primary Examiner*—Thanh-Tam T Le

(57) ABSTRACT

An electrical connector with a release mechanism configured to prevent it from hooking other cables lying transverse to its path of removal from its receptacle, when it is being removed. The default or equilibrium state of the release mechanism is such that its end remains in contact with the body of the connector, whereby any transverse cable in its path of removal simply slides over the release mechanism of the connector being removed. This prevents damage to the connector and damage to other cables/equipment which would otherwise be ensnared. Embodiments of the present invention can be used with virtually all standard connectors such as, for example, RJ11, RJ14 and RJ45 (telephone registered jacks) or 8P8C, 6P6C and 6P4C (modular connectors).

5 Claims, 6 Drawing Sheets

EASILY-REMOVEABLE ELECTRICAL CONNECTOR

BACKGROUND

Certain kinds of electrical connectors are attached to a copper-wire conductor cable and, more specifically, are attached to the ends of mutually insulated electrical conductors which are encapsulated by that protective and insulating cable. The Registered Jack 11 (RJ-11) connectors are familiar connectors that are attached to both ends of a residential telephone cable which telephone users plug between the back of their telephone instruments and their wall outlets. These male connectors make a snapping sound when inserted into the female receptacles in the back of the telephone and in the wall, thereby indicating that they are properly locked in place. The connector has a raised plastic clip on the outside of its body, which is accessible to a user and can be depressed by the user's thumb when the connector is to be removed from its receptacle. Typically, there may not be many telephone or other cables in the vicinity of the telephone cable being removed and the removal experience is usually without difficulty.

However the situation can be quite different with different connectors. For example, the Registered Jack 45 (RJ-45) connector looks very similar to an RJ-11 connector but is wider. It is an eight wire connector, typically used to connect computers onto a local area network (LAN), especially Ethernets. It also makes the same snapping sound when properly inserted into its mating receptacle, and has a similar raised plastic clip to be depressed by the user when the connector is to be removed. However, in computer environments, there are typically many cables lying around. Particularly, if computer equipment is rack mounted, where many pieces of equipment, such as, for example, severs, digital switches, routers, power supplies, data storage units, copiers, fax machines, printers and other equipment are all crowded into a small space, a "rats-nest" of cables can abound.

In this crowded computer cabling environment, it can be a substantial challenge to remove an Ethernet cable with an RJ-45 connector attached to its end. The raised plastic clip, also known herein as the "hook" or the "release mechanism" seems to catch on every cable crossing its path. Wiggling, jiggling and tugging-on the cable attached to the connector that is being removed in order to free its hook is the normal user response. Further removal progress is made until the next cross-cable or some other barrier is encountered by the hook. At some point, the user's frustration level may get the best of him/her and the user yanks on the cable causing damage, most likely by breaking the hook on the cable. In addition, other damage can be visited upon other cable connections or components as a result of this yanking. Once the hook is broken, that cable connector becomes essentially worthless because it is no longer a reliable cable connector; although it can still be plugged-in, it can no longer be locked-in to its receptacle. The cable connector and cable are then typically discarded, and this is a wasteful activity.

There is a need for an improved connector which maintains the functionality of a standard connector, but has an improved design which would allow it to be removed from a rats-nest of cables under adverse circumstances such as those described above without ensnaring other cables and breaking or causing other damage to other cables and equipment.

BRIEF DESCRIPTION OF THE DRAWINGS

FIG. 1 is a perspective diagram of a typical electrical connector such as an RJ-45 connector or the like;

FIG. 2 is a schematic diagram of a side view of a typical electrical connector such as an RJ-45 connector or the like;

DETAILED DESCRIPTION OF PREFERRED EMBODIMENTS

The present invention relates to an improved male electrical connector, such as, for example, an improved RJ-45 connector. The release mechanism for the connector is configured in a novel manner to prevent ensnarement of nearby cables associated with other connectors when removing the connector from its electrical contact position within its female receptacle. The avoidance of that ensnarement not only facilitates removal, but it prevents damage to the connector, to its cable and to other cables crossing its path of removal. The principles of the present invention permit this improvement to be added to any connector of this ilk.

Figure 1:
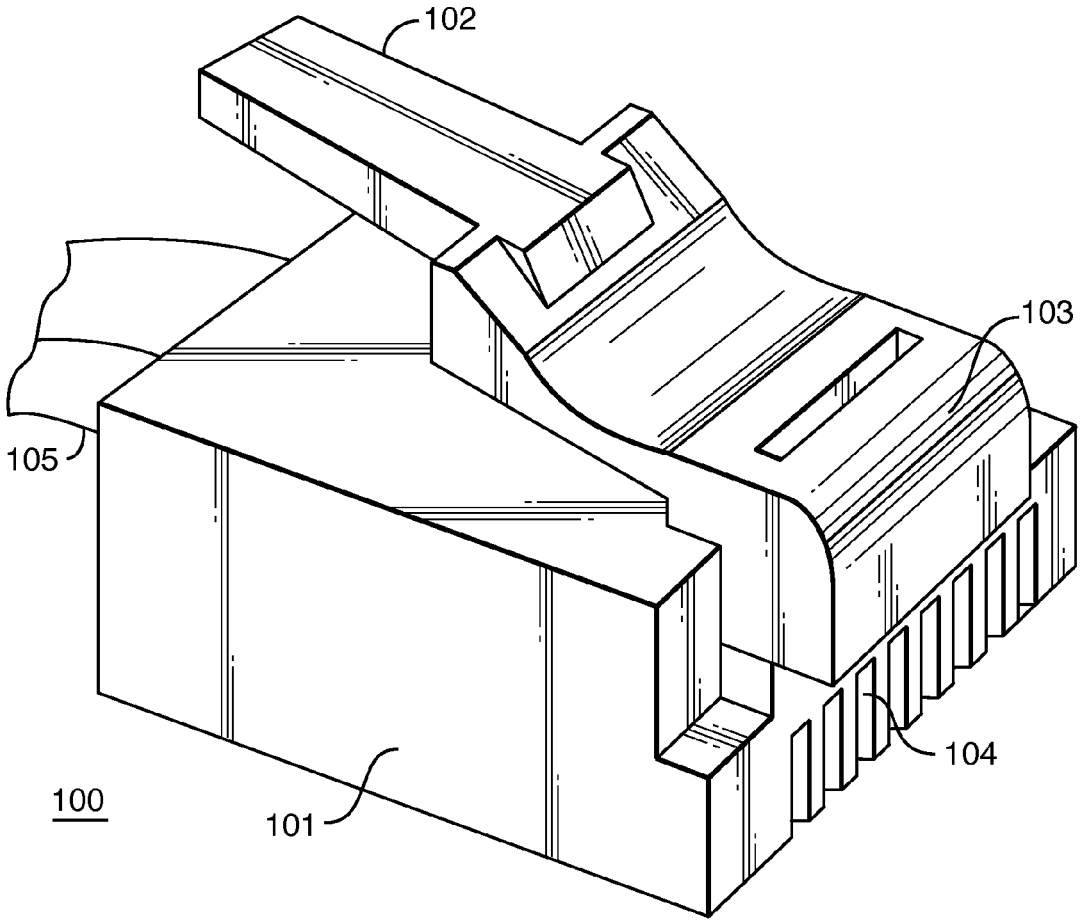

FIG. 1 is a perspective diagram of a typical electrical connector 100 such as an RJ-45 connector or the like. This kind of connector can be used with Ethernet cables for computer equipment interconnection. The connector has a connector body 101, made from plastic. A thumb-operable release mechanism or arm 102, also made from plastic, is molded into the body of the connector at protuberance 103. The release mechanism can be depressed to enable it to be released from its receptacle. Electrical contacts 104 are exposed metal contacts which, after insertion of connector 100 into its receptacle, make good electrical contact between an electrical cable 105 affixed to connector 100 and equipment electrically connected to that receptacle. Note that arm 102 is angled upward or away from the surface of connector 100. This is the normal or default position of arm 102 when inserted in its connector or when outside of its connector.

Figure 2:
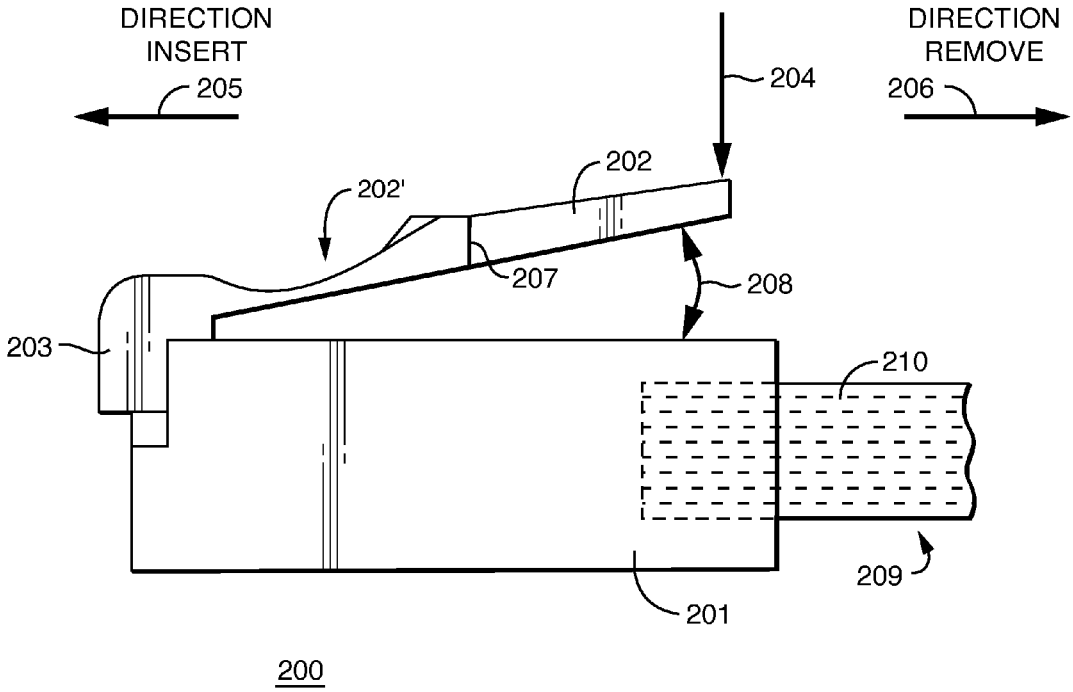

FIG. 2 is a schematic diagram of a side view of a typical electrical connector 200 such as an RJ-45 connector or the like. Connector 200 has a connector body 201 which encapsulates and protects conductive metal contacts (e.g., contacts 104 as shown in FIG. 1) which are each connected to a different electrical conductor 210 shown in dashed line(s) because they are included inside of cable 209. It is to be understood that conductors 210 are positioned within cable 209 in a typical mutually-insulated conductor distribution and are not necessarily stacked in a vertical manner as shown in the Fig. for case of illustration. Further, conductors 210 are shown as foreshortened for ease of illustration and it should be understood that the conductors actually extend throughout connector 200 in the usual manner to make operative connection with conductive metal contacts, such as contacts 104 shown in FIG. 1.

Protuberance 203 is molded with body 201 out of plastic such as, e.g. polycarbonate, and it cantilevers arm or release mechanism 202 in the angular orientation shown. The default, or normal equilibrium, position of release mechanism 202 is angle 208, possibly 25 degrees or so. The exact angle is not critical as long as it is sufficiently large to properly lock with its mating connector or receptacle (not shown in this Fig.). This default position is the position that the mechanism assumes when it is locked in place inside its mating connector which is electrically coupled to electrical equipment such as, e.g., computer or telephonic equipment. It is locked or held in place in its mating receptacle by latching mechanism 207, which are two protruding flat surfaces, protruding outwardly from arm 202 on both sides of that arm (the edge of only one protruding flat surface being visible in this view). It is also molded together with the cantilevered arm and connector body from plastic.

Force is applied, typically by a thumb of a user or technician, in direction 204 to push arm 202 down to the surface of connector 200, where angle 208 is reduced to approximately zero degrees. Plastic arm 202 is sufficiently resilient to bend because narrow-neck portion 202 of arm 202 is substantially thinner (possibly 75% thinner) than the thickness of arm 202. Arm 202 bends at its 202' location. In that position, the connector can be inserted into, or removed from, its mating connector receptacle for reasons explained below in connection with FIG. 4. After insertion or removal, resilience of section 202' of arm 202 returns arm 202 to its default position. The direction of insertion is direction 205, and the direction of removal is direction 206.

In operation, assume, for example, that cable 209 is to be removed. After connector 200 is released from its un-shown mating connector, whereupon its arm 202 re-assumes its default position as shown in the Fig., connector 200 is pulled in direction 206 by a user or technician tugging on cable 210 in direction 206. It is plainly observable that arm 202 is in a likely position to get ensnared on any cable or wire that is oriented transverse to direction 206. With sufficient force applied to arm 202, it is bent in the opposite direction (counterclockwise) until it, typically, breaks away from the rest of connector 200. This problem is solved by embodiment of the present invention.

Figure 3:
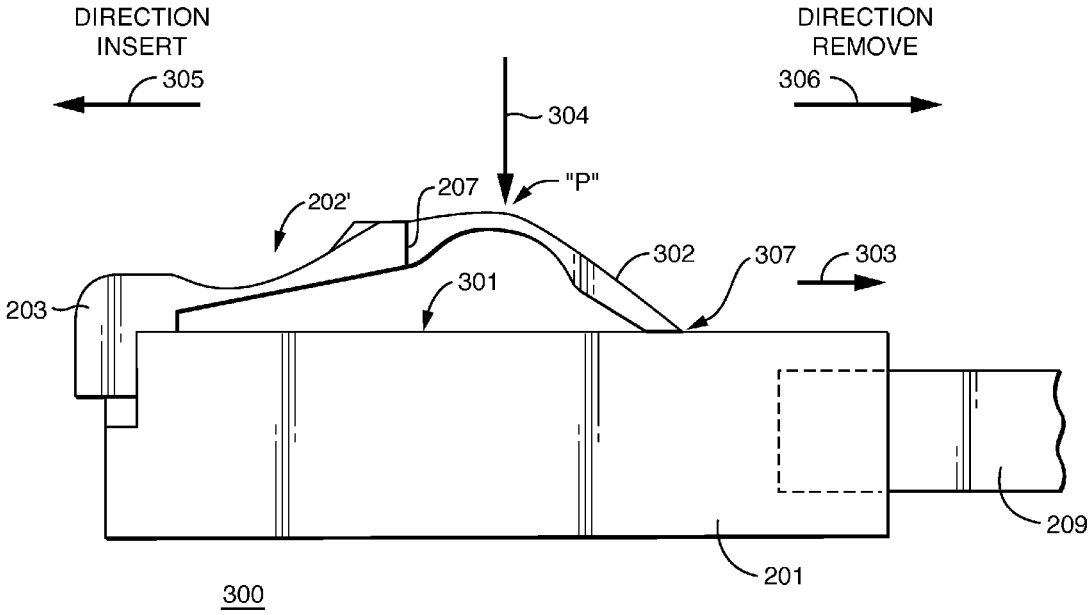
FIG. 3 is a schematic diagram of a side view of an exemplary embodiment of an electrical connector in accordance with the principles of the present invention.

FIG. 3 is a schematic diagram of a side view of an exemplary embodiment of an electrical connector 300 in accordance with the principles of the present invention. Connector body 201, cable 209, protuberance 203, narrow neck 202' and latching mechanism 207 which are all shown in FIG. 3 are similar or identical to their counterparts shown in FIG. 2. Arm or release mechanism 302, however, is substantially different from arm 202 shown in FIG. 2. Arm 302 is configured in a curve so that it forms a smooth and continuous surface on its convex (outer) side, and so that end 307 of arm 302 touches the surface 301 of connector 300, as shown. In addition, at a central location along the concave (inside) side of arm 302 a portion of thickness of the arm is removed. The resulting thickness of arm 302 at and near location "P" is approximately the same as the thickness of narrow neck 202'. The narrowness of the arm at location P permits easy flexing of the arm at that location, in addition to the previous flexing of the arm at narrow neck location 202'. In addition, arm 302 can be made of a more resilient plastic than polycarbonate, as may be desired, to permit appropriate operation.

In operation, when thumb-force is applied in direction 304 at point P on release arm 302, it tends to flatten making end 307 of arm 302 slide across the surface 301 of component body 201 in direction 303. Upon release of pressure at point P, arm 302 resiliently returns to its former shape, as shown in FIG. 3. In its former shape end 307 remains in contact with surface 301 of component body 201. End 307 stays in contact with the surface 301 of component body 201 after pressure is released from point P. Arm 302 bends and flexes at points P and narrow neck 202'.

This embodiment of the present invention addresses the arm-breakage problem discussed above. Because end 307 stays in contact with the surface 301 of component body 201 at all times, and because the outer surface of plastic arm 302 is smooth, the entanglement problem of the standard connector described above is completely eliminated. In other words, after a first thumb force is applied at point P in direction 304 whereupon connector 300 is inserted via direction 305 into its receptacle (not shown), and after a second thumb force is subsequently applied at point P in direction 304 whereupon connector 300 is removed via direction 306 from the receptacle, connector 300 can be easily pulled out of a multi-cable environment (a rats nest of cables) by merely pulling on cable 209 and arm 302 shall not get caught on any transverse cabling.

Figure 4:
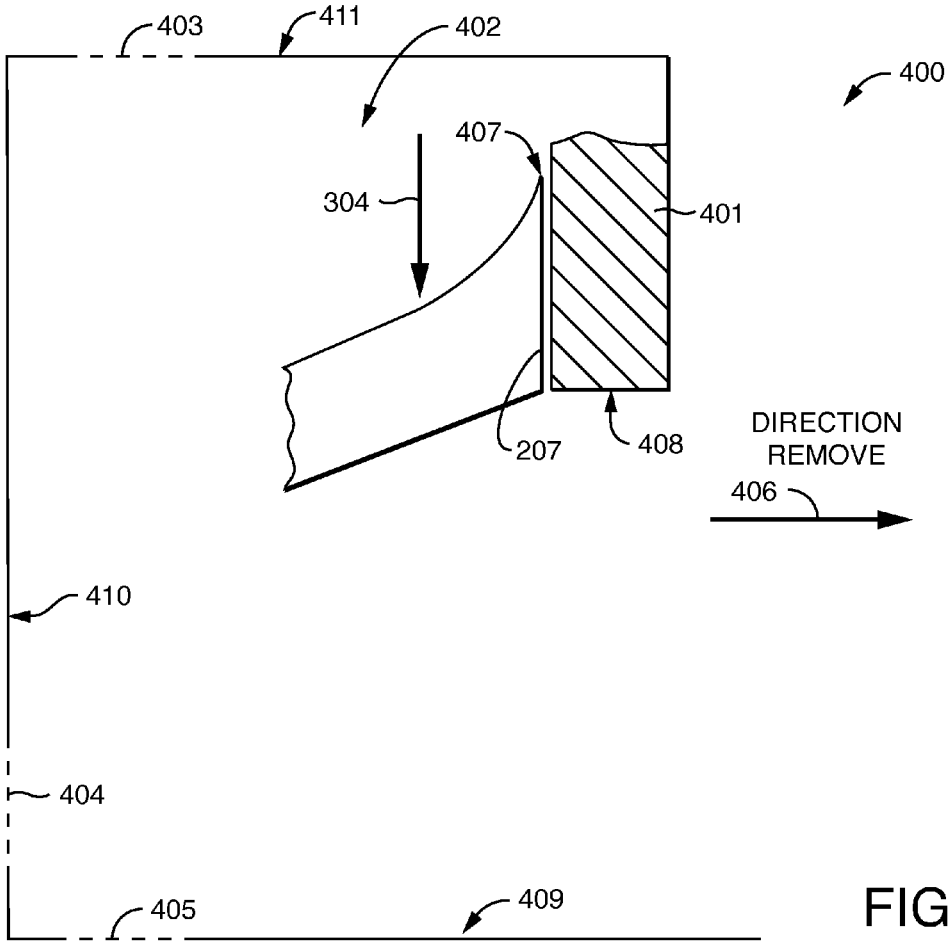
FIG. 4 is a schematic diagram of certain detail of the connector of FIG. 3 in context of a receptacle for the connector.

FIG. 4 is a schematic diagram of detail 400 of latching mechanism 207 of the connector of FIG. 3, depicted in the context of a receptacle for connector 300. Reference should be made to both FIGS. 3 and 4 in connection with the following description. Latching mechanism is shown in its latched state, being held in place by retaining wall 401. Retaining wall 401 is part of the receptacle connector, matingly-compatible with connector 300. The recipient connector is not shown in detail since it is not germane to the embodiments of the present invention and, therefore, is genetically shown as space 402. Space 402 is defined by boundaries 409, 410 and 411 which by implication of dashed lines 403, 404 and 405, is expandable or contractible to an appropriate size and configuration to perfectly mate with connector 300.

In operation, when release arm 302 is depressed by thumb force at point P applied in direction 304, latching mechanism 207 is displaced vertically downward in terms of its orientation in FIGS. 3/4. In FIG. 4, when latching mechanism is displaced downward to the extent that its upper end 407 is beneath lower end 408 of retaining wall 401, then connector 300 can be removed in direction 406 from its receptacle 402. This occurs when, in FIG. 3, arm 302 is essentially flat against the surface of component body 201. End 307 slides to its maximum displacement in direction 303 while maintaining physical contact with the surface of component body 201. After connector 300 is removed from its receptacle 402, arm 302 resiliently returns to its default configuration as shown in FIG. 3, with end 307 in firm contact with surface of component body 201 to guarantee no entanglements caused by arm 302.

Figure 5:
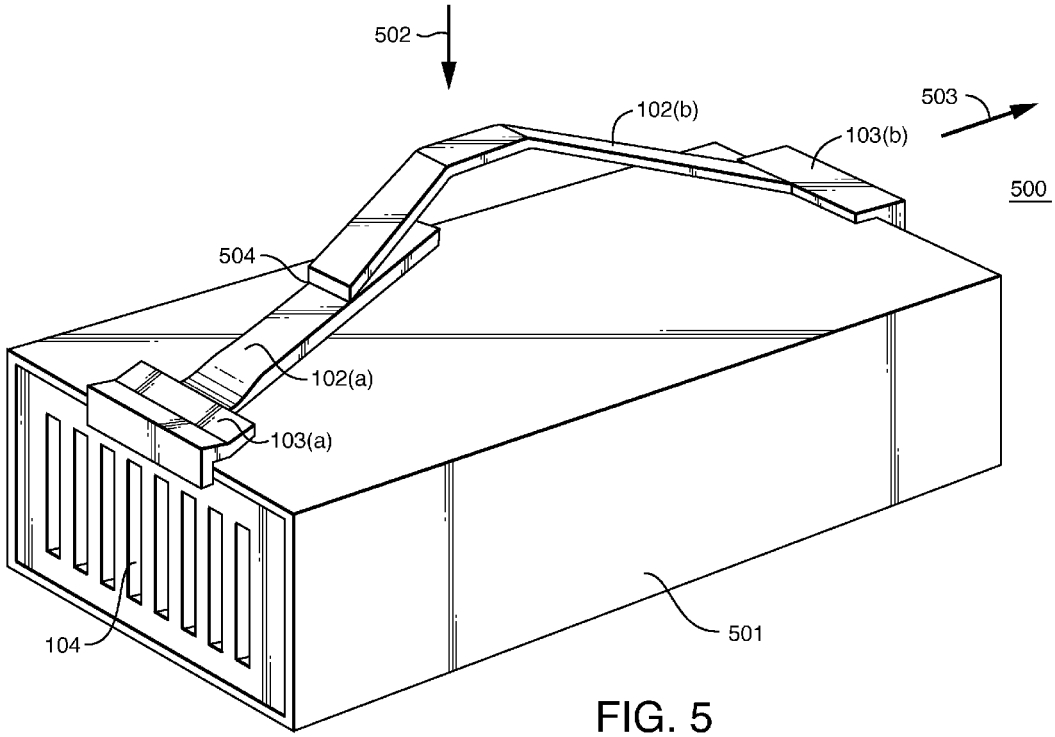
FIG. 5 is a perspective view of another exemplary embodiment of an electrical connector in accordance with the principles of the present invention.

FIG. 5 is a perspective view of another exemplary embodiment of an electrical connector 500 in accordance with the principles of the present invention. Connector body 501 is the essentially the same as connector body 101 shown in FIG. 1, but the exterior profile of connector body 501 may be slightly modified to accommodate an additional protuberance. Protuberances 103(*a*) and 103(*b*) are each essentially the same as protuberance 103 in FIG. 1, but are labeled with (a) and (b) to distinguish them from each other. Protuberance 103(*a*) is located at the front end of the connector where electrical contacts 104 are located, and protuberance 103(*b*) is located on the back end of the connector where the electrical cable (not shown in this Fig.) would be clamped in place by the connector.

Release mechanism component (or arm) 102(*a*) is cantilevered from protuberance 103(*a*) and is similar to release mechanism 102 in FIG. 1, but may be a bit shorter in length. Release mechanism component (or arm) 102(*b*) is cantilevered from protuberance 103(*b*). Arm 102(*b*) is configured into a default position having a bias causing it to press onto the upper surface of release mechanism 102(*a*). Arm 102(*b*) is further configured so that its movable end 504 can ride or slide on top of the surface of release mechanism component 102(*a*) when operated by a user. Conversely, arm 102(*a*) slides below the bottom of movable end 504 of arm 102(*b*).

In operation, when arm 102(*b*) is pressed downward in direction 502, it shall bend or flex at its narrow neck (detail not shown in this Fig.) located near its protuberance 103(*b*). The downward displacement of arm 102(*b*) shall cause a downward displacement of arm 102(*a*) as movable end 504 slides or rides on top of arm 102(*a*). The two arms cooperate and their contact point slides relative to each other. When release mechanism 102(*a*) is sufficiently displaced downward, its latching mechanism (not shown in this Fig.) is also sufficiently displaced downward so that the upper end of the latching mechanism falls beneath the lower end of the retaining wall (not shown in this Fig). The latching mechanism and retaining wall detail are not shown in this Fig. but they are the same as that shown in, and discussed with respect to, FIG. 4. Connector 501 can then be removed in direction 503.

In accordance with principles of the present invention, because release mechanism component 102(*b*) is cantilevered from protuberance 103(*b*), its resulting orientation with respect to component body 501 avoids any type of "hook" configuration that is otherwise inherent with a standard connector. Therefore, component body 501 can be pulled in direction 503 without hooking onto any other cables that may be lying transverse to direction 503.

Figure 6:
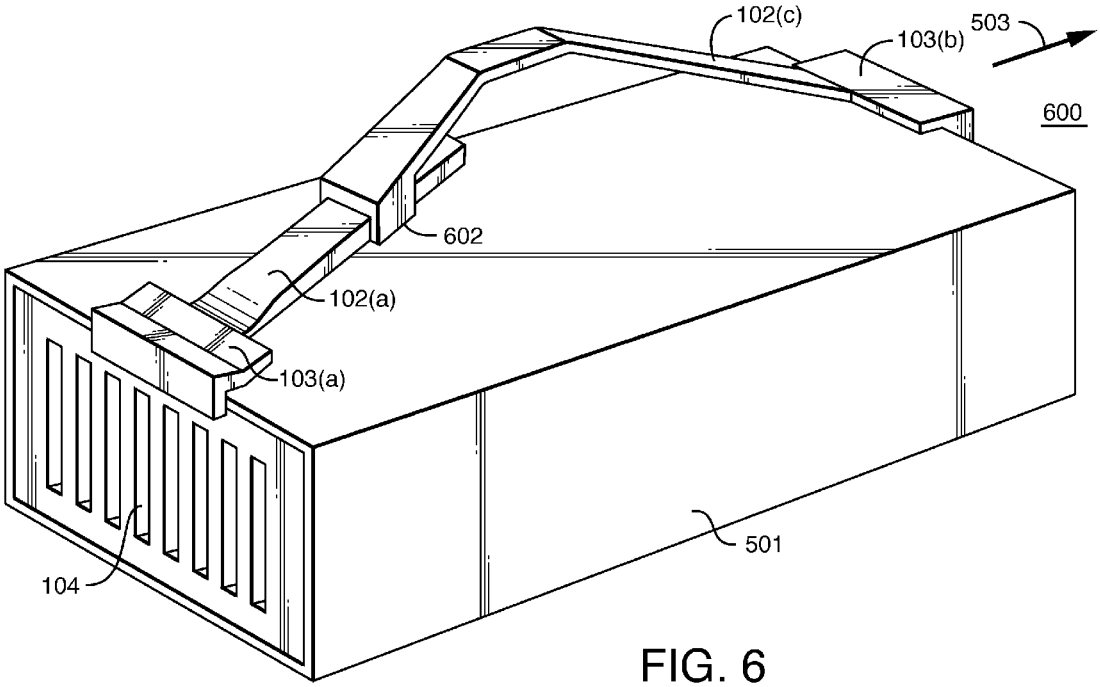
FIG. 6 is a perspective view of yet another exemplary embodiment of an electrical connector in accordance with the principles of the present invention.

FIG. 6 is a perspective view of yet another exemplary embodiment of an electrical connector 600 in accordance with the principles of the present invention. It is identical to connector 500 in all respects but for one. Release mechanism component 102(*c*) is different from release mechanism component 102(*b*) because it includes two guide walls 602, each positioned on opposite sides of release mechanism component 102(*a*) (and only one such guide wall being shown in FIG. 6). The guide walls constrain both sides of arm 102(*a*). Guide walls 602 offer additional stability by discouraging any unwanted lateral or transverse relative motion of release mechanism components 102(*a*) and/or 102(*c*) when the components are activated by the user.

It should be understood that the embodiments shown in FIGS. 5 and 6 are intended to represent standard Registered Jack connectors. The latching mechanism 207 which is configured with arm 102(*a*) and which is not shown in FIGS. 5 and 6 shall engage retaining wall 408 of FIG. 4, in the standard manner. No reconfiguring of the connectors of FIGS. 5 and 6 representing, e.g., standard RJ-45 connectors, shall be required for them to operate with their standard female receptacles.

In the preceding specification, various preferred embodiments have been described with reference to the accompanying drawings. It will, however, be evident that various modifications and changes may be made thereto, and additional embodiments may be implemented, without departing from the broader scope of the invention as set forth in the claims that follow. For example, many varieties of connector can be improved by embodiments of the present invention including, without limitation, RJ11, RJ14, RJ45, RJ48, RJ49, RJ61, 4P4C, 6P4C, 6P6C and/or 8P8C where "P" stands for position and "C" stands for contact. For example, an 8P8C modular plug and jack is an eight-position, eight-contact entity. Accordingly, the specification and drawings are to be regarded in an illustrative rather than restrictive sense.

What is claimed is:

1. Apparatus comprising:

an electrical connector having a body containing a plurality of electrical contacts, said connector being affixed to one end of an insulating cable containing a like plurality of electrical conductors, each one of said conductors being conductively connected to a different one of said contacts;

a latching mechanism located external said connector body and affixed to said connector body, for holding said electrical contacts in operative contact with complementary electrically-conductive apparatus; and a release mechanism, affixed to said latching mechanism and manually operable by a user of said connector, for releasing said connector from said complementary electrically conductive apparatus, said release mechanism thereafter retaining a configuration for avoiding ensnarement by other cables when said cable is withdrawn by said user, wherein said release mechanism is a lever having two ends, one of said ends operatively connected to said latching mechanism and the other end configured to touch the body of said connector at all times before, during and after operation of said release mechanism;

wherein only the other end of said release mechanism slides away from said one end and on said body of said connector when said release mechanism is operated and thereafter returns to said configuration.

2. The apparatus of claim 1 wherein said release mechanism is made from resilient non-conductive material.

3. The apparatus of 2 wherein said resilient non-conductive material is plastic.

4. The apparatus of claim 1 wherein said body of said connector is the same as the body of a connector selected from the group consisting of: RJ11, RJ45, RJ48, RJ49, RJ61, 4P4C, 6P4C, 6P6C and 8P8C.

5. In an improved electrical cable connector having a latching mechanism for holding said connector in conductive contact, the improvement comprising:

a user-operated release mechanism, for operating upon said latching mechanism to release said electrical cable connector from said conductive contact while only an end of said release mechanism slides away from said latching mechanism and, along the body of said connector during operation of said release mechanism and stays in contact with said body of said connector at all times before, during and after operation of said release mechanism to avoid ensnarement by cables from other connectors in close physical proximity to said electrical cable connector when said electrical cable connector is withdrawn by said user.

* * * * *